US012060895B2

(12) United States Patent
Choi et al.

(10) Patent No.: US 12,060,895 B2
(45) Date of Patent: Aug. 13, 2024

(54) CROSS-FLOW FAN

(71) Applicant: LG ELECTRONICS INC., Seoul (KR)

(72) Inventors: Jinwook Choi, Seoul (KR); Jeongtaek Park, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/802,310

(22) PCT Filed: Dec. 10, 2020

(86) PCT No.: PCT/KR2020/018036
§ 371 (c)(1),
(2) Date: Aug. 25, 2022

(87) PCT Pub. No.: WO2021/172716
PCT Pub. Date: Sep. 2, 2021

(65) Prior Publication Data

US 2023/0092864 A1 Mar. 23, 2023

(30) Foreign Application Priority Data

Feb. 25, 2020 (KR) ..... 10-2020-0023209

(51) Int. Cl.
*F04D 29/66* (2006.01)
*F04D 29/28* (2006.01)
*F04D 29/30* (2006.01)

(52) U.S. Cl.
CPC ..... *F04D 29/661* (2013.01); *F04D 29/281* (2013.01); *F04D 29/30* (2013.01)

(58) Field of Classification Search
CPC ..... F04D 29/661; F04D 29/66; F04D 29/26; F04D 29/281; F04D 29/30; F04D 29/384;
(Continued)

(56) References Cited

U.S. PATENT DOCUMENTS 5,064,346 A * 11/1991 Atarashi ..... F04D 17/04 416/178
8,197,181 B2 * 6/2012 Park ..... F04D 29/666 415/53.3

(Continued)

FOREIGN PATENT DOCUMENTS

CN 103277336 9/2013
CN 207814038 9/2018

(Continued)

OTHER PUBLICATIONS

CN109139545A Espacenet Translation (Year: 2019).*

(Continued)

*Primary Examiner* — Juan G Flores
*Assistant Examiner* — Ryan C Clark
(74) *Attorney, Agent, or Firm* — KED & ASSOCIATES

(57) ABSTRACT

A cross-flow fan, and blades of a cross-flow fan are provided. The cross-flow fan includes a rotary shaft; a plurality of blades that extends in a direction parallel to the rotary shaft and having a positive pressure surface and a negative pressure surface; and a connector that connects the rotary shaft and the plurality of blades. At least one protrusion that protrudes in a thickness direction and extends in a longitudinal direction of the plurality of blades is formed on the plurality of blades, and by means of the at least one protrusion formed on a blade surface, a flow separation phenomenon caused by friction with the blade surface is suppressed, thereby reducing noise generated by the cross-flow fan.

10 Claims, 6 Drawing Sheets
(1 of 6 Drawing Sheet(s) Filed in Color)

(58) Field of Classification Search
CPC ..... F04D 29/681; F04D 29/283; F04D 17/04; F05D 2240/305; F05D 2240/306; F05D 2250/182; F05D 2260/961
See application file for complete search history.

(56) References Cited

U.S. PATENT DOCUMENTS

| | | | | |
|---|---|---|---|---|
| 2012/0171013 | A1 | 7/2012 | Ohtsuka et al. | |
| 2012/0263573 | A1* | 10/2012 | Tadokoro | F04D 29/283 415/53.1 |
| 2013/0004329 | A1* | 1/2013 | Shiraichi | F04D 17/10 416/243 |
| 2013/0101405 | A1 | 4/2013 | Shiraichi et al. | |
| 2014/0301825 | A1* | 10/2014 | Tian | F04D 17/04 415/53.1 |

FOREIGN PATENT DOCUMENTS

| | | | | |
|---|---|---|---|---|
| CN | 109139545 | | 1/2019 | |
| CN | 109139545 | A * | 1/2019 | F04D 29/26 |
| EP | 2597315 | | 5/2013 | |
| JP | H9-280196 | | 10/1997 | |
| JP | 2010-174852 | | 8/2010 | |
| JP | 2010-209797 | | 9/2010 | |
| JP | 2012-7585 | | 1/2012 | |
| JP | 2012-13092 | | 1/2012 | |
| JP | WO 2013 /150673 | | 12/2015 | |
| KR | 10-2011-0122220 | | 11/2011 | |
| WO | WO 2012/118057 | | 9/2012 | |

OTHER PUBLICATIONS

International Search Report dated Apr. 6, 2021 issued in Application No. PCT/KR2020/018036.
Japanese Office Action dated Oct. 10, 2023 issued in Application No. 2022-550862.
Extended European Search Report dated Feb. 15, 2024 issued in Application No. 20921039.2.

* cited by examiner

CROSS-FLOW FAN

CROSS-REFERENCE TO RELATED APPLICATION(S)

This application is a U.S. National Stage Application under 35 U.S.C. § 371 of PCT Application No. PCT/KR2020/018036, filed Dec. 10, 2020, which claims priority to Korean Patent Application No. 10-2020-0023209, filed Feb. 25, 2020, whose entire disclosures are hereby incorporated by reference.

BACKGROUND

1. Field

TA cross-flow fan, and more particularly, a cross-flow fan blade is disclosed herein.

2. Background

Blower fans which suction and discharge air by rotation are classified into various types, such as a centrifugal fan, an axial fan, and a cross-flow fan, depending on a positional relationship between a rotary shaft and a flow direction. Among these blower fans, the cross-flow fan generally includes a rotary shaft and a blade extending long or lengthwise in a direction of the rotary shaft, and a large amount of air is suctioned in a transverse direction.

One of the factors that determines performance of the cross-flow fan is noise, and the noise of the cross-flow fan is mainly generated near the blade. The biggest cause of noise generation near the blades is a flow separation phenomenon caused by friction with a blade surface, more specifically, the noise is generated as separated flows near the blade prevent air from being suctioned into the cross-flow fan.

In order to solve the above problems a related patent KR 2011-0122220A discloses a protrusion structure formed in or on an outer edge of a blade, but there is a problem that a flow separation phenomenon occurring over a positive pressure surface and a negative pressure surface of the blade cannot be addressed. In order to solve the above problem, another related patent U.S. Patent Publication No. 2012/0171013A1 discloses a blade structure having a plurality of inflection points in a line of a camber line, but there is a problem in weak durability and insufficient adaptability to various flow angles.

An object of embodiments is to reduce noise generated by a cross-flow fan by reducing an amount of separated flows near a blade.

Another object of embodiments is to improve durability of the blade by changing a thickness of the blade and to have versatility for various flow angles.

Yet another object of embodiments is to maximize a noise reduction effect at a low manufacturing cost by designing the blade of the present disclosure based on a conventional blade specification.

The objects of embodiments are not limited to the objects mentioned above, and other objects not mentioned will be clearly understood by those skilled in the art from the following description.

In order to achieve the above objects, a cross-flow fan according to an embodiment includes: a rotary shaft; a plurality of blades spaced apart from each other at a predetermined angle about the rotary shaft, each blade extending in a direction parallel to the rotary shaft and having a positive pressure surface and a negative pressure surface; and a connector connecting the plurality of blades and the rotary shaft. A protrusion protruding in a thickness direction of the blades on at least one surface of the positive pressure surface and the negative pressure surface and extending in a longitudinal direction of the blades is formed in each blade among the plurality of blades The protrusion may extend from one (first) end to the other (second) end in the longitudinal direction of the each blade. The protrusion may be formed in each of the positive pressure surface and the negative pressure surface, and a protrusion formed in the positive pressure surface and a protrusion formed in the negative pressure surface may protrude in opposite directions to thereby form a pair of opposing protrusions. The opposing protrusions may have each a cross section of a circular shape.

The opposing protrusions may be formed as a plurality of opposing protrusions so as to be spaced apart from each other in a direction of a camber line of the each blade. One (first) of the plurality of opposing protrusions may be formed in an inner edge of the each blade, and the other (second) one of the plurality of opposing protrusions may be formed in an outer edge of the each blade. Centers of the opposing protrusions may be located on a camber line of the each blade.

Intervals between the plurality of opposing protrusions may be formed to divide a code line into equal parts when a foot of perpendicular is drawn onto the code line from a center of each of the opposing protrusions. Diameters of the plurality of opposing protrusions may be formed in such a way that an opposing protrusion located closer to the inner edge has a greater diameter.

The plurality of opposing protrusions may be connected by a beam. A thickness of the beam may decrease in a direction away from the inner edge.

A surface of the each blade including the protrusion may have a continuous curvature distribution.

The details of other embodiments are included in the detailed description and

DRAWINGS

According to the cross-flow fan of embodiments, there is one or more of the following effects.

First, as a flow separation phenomenon caused by friction with a blade surface is suppressed due to protrusions formed in the blade surface, it is possible to reduce noise generated by a cross-flow fan.

Second, by varying a thickness of a blade and a diameter of a protrusion along a camber line, it is possible to improve durability of the blade and to have adaptability to various flow angles.

Third, by designing the blade of the present disclosure based on shape specification of a conventional blade, it is possible to reduce noise without a significant change in manufacturing cost.

The effects of embodiments are not limited to the above-described effects, and other unmentioned effects will be clearly understood to those skilled in the art from the description of claims.

DETAILED DESCRIPTION

Figure 1:
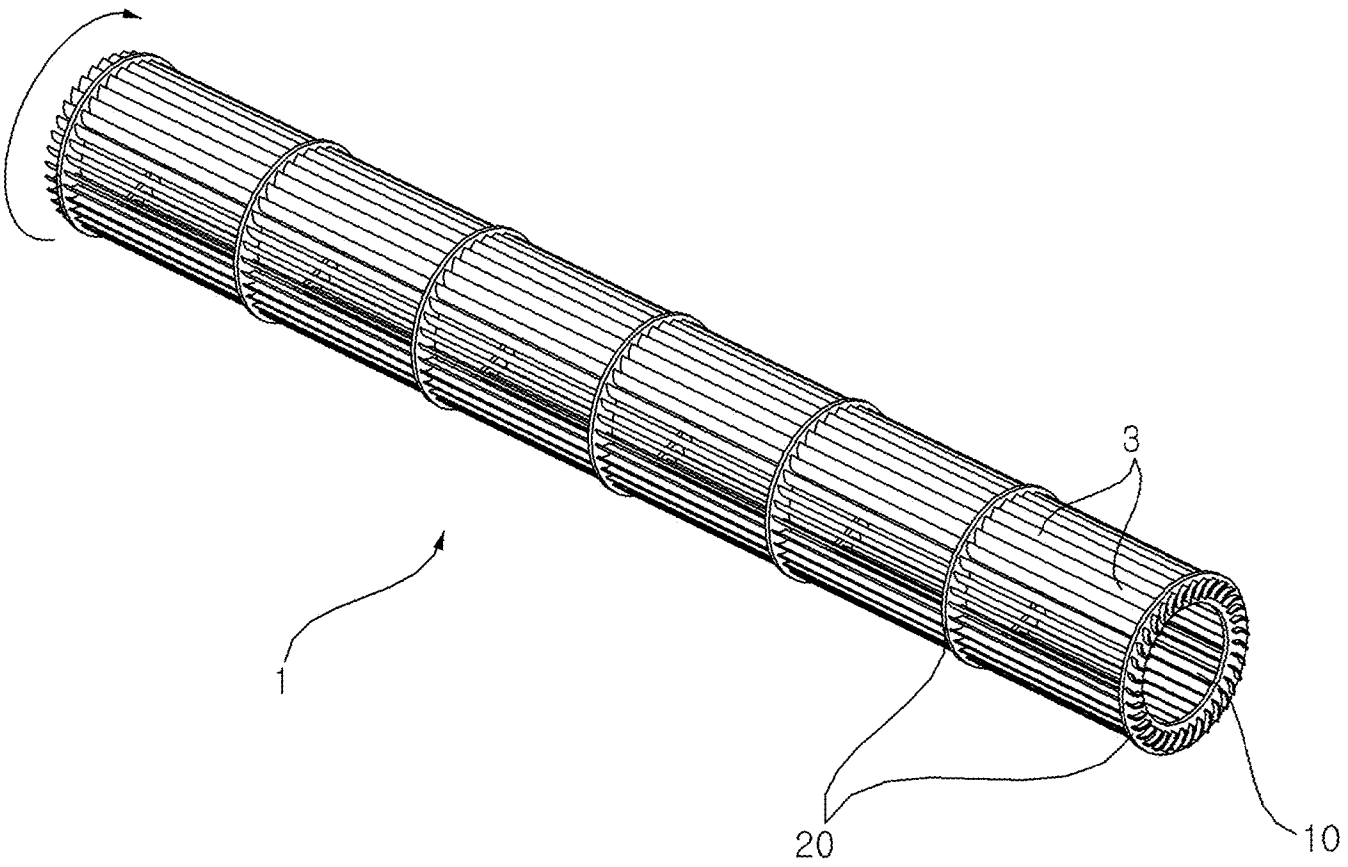
FIG. 1 is a perspective view of a general cross-flow fan.

"The patent or application file contains at least one drawing executed in color. Copies of this patent or patent application publication with color drawing(s) will be provided by the Office upon request and payment of the necessary fee."

Advantages and features of embodiments and a method of achieving the same should become clear with embodiments described in detail below with reference to the accompanying drawings. However, embodiments are not limited to the embodiments disclosed below and may be realized in various other forms, the embodiments make the disclosure complete and are provided to completely inform one of ordinary skill in the art to which the embodiments pertain of the scope, and the embodiments are defined only by the scope of the claims. Like reference numerals refer to like elements throughout the specification.

Hereinafter, embodiments will be described with reference to the drawings for explaining a cross-flow fan according to embodiments.

Referring to FIG. 1, a blade 3 indicates a conventional blade 3 distinct from a blade 30 and 40 used in an embodiment, and this is merely to describe arrangement relationship among the blade 3, a rotary shaft 10, and a connector 20 and has nothing to do with the gist.

Referring to FIG. 1, a cross-flow fan 1 includes the rotary shaft 10 capable of being rotated by power from an external power source (not shown), the blade 3 that suctions external air into the cross-flow fan 1 by rotation, and the connector 20 that connects the rotary shaft 10 and the blade 3. There may be a plurality of blades 3, and the plurality of blades 3 is spaced apart from each other at a predetermined angle relative to the rotary shaft 10. The blade 3 may be disposed to be parallel with the rotary shaft 10 with a length in a direction of the rotary shaft 10, and a plurality of connectors 20 may be spaced apart from each other in a direction of the rotary shaft 10 so as to connect the rotary shaft 10 and the blade 3.

Hereinafter, with reference to FIG. 2, symbols commonly used in blade design are defined for explanation.

An end located close to a rotary shaft on a surface of a blade is referred to as an inner edge E1, and an end located far from the rotary shaft is referred to as an outer edge E2. A portion where each of the inner edge E1 and the outer edge E2 is formed may have a semicircular shape, a diameter of the semicircular shape of the inner edge E1 is referred to as an inner diameter D1, and a diameter of the semicircular shape of the outer edge E2 is referred to as an outer diameter D2.

A curve passing through both the inner edge E1 and the outer edge E2 and connecting a midpoint of thickness of the blade is referred to as a camber line C, and a straight line connecting the inner edge E1 and the outer edge E2 is referred to as a code line L.

An angle between a direction of rotation and the camber line C at the inner edge E1 is referred to as an inner angle B1, and an angle between the direction of rotation and the camber line C at the outer edge E2 is referred to as an outer angle B2.

Hereinafter, a blade 30 according to an embodiment will be described with reference to FIG. 3 based on the description of FIGS. 1 and 2.

The blade 30 shown in FIG. 3 may be disposed to replace the conventional blade 3 in the configuration of the cross-flow fan 1 shown in FIG. 1, and an arrangement and connection relationship with rotary shaft 10 and connector 20 may be the same as described with reference to FIG. 1.

A surface of the blade 30 may include a positive pressure surface 31 receiving a positive pressure by rotation and a negative pressure surface 32 receiving a negative pressure by rotation. The inner edge E1 and the outer edge E2 may be formed at a portion where the positive pressure surface 31 and the negative pressure surface 32 meet each other.

As shown in FIG. 1, a plurality of blades 30 may be spaced apart from the rotary shaft 10 at a predetermined angle, and accordingly, the plurality of blades 30 may be disposed in such a way that a negative pressure surface 32 of each blade 30 faces a positive pressure surface of a blade ahead while a positive pressure surface 31 of a corresponding blade 30 faces a negative pressure surface of a blade behind.

A positive pressure protrusion 33*a* that protrudes in a thickness direction of the blade 30 may be formed in the positive pressure surface 31, and a negative pressure protrusion 33*b* that protrudes in the thickness direction of the blade 30 may be formed in the negative pressure surface 32. A plurality of positive pressure protrusions 33*a* and a plurality of negative pressure protrusions 33*b* may be spaced apart from each other in a direction of the camber line C along the positive pressure surface 31 and the negative pressure surface 32, respectively. The positive pressure protrusion 33*a* and the negative pressure protrusion 33*b* may be formed in the inner edge E1 or the outer edge E2, respectively, and a cross-sectional shape thereof may have a semi-circular shape.

The positive pressure protrusion 33*a* and the negative pressure protrusion 33*b* may be formed at positions symmetrical with respect to the camber line C, thereby forming a pair of opposing protrusions 33. An opposing protrusion 33 may be formed to have a cylindrical shape in a cross-section view of the blade 30.

The opposing protrusion 33 may be formed to extend from one (first) end to the other (second) end of the blade 30 in a longitudinal direction of the blade 30. A plurality of opposing protrusions 33 may be spaced apart from each other in the direction of the camber line C, and may be parallel to the rotary shaft 10.

Figure 3:
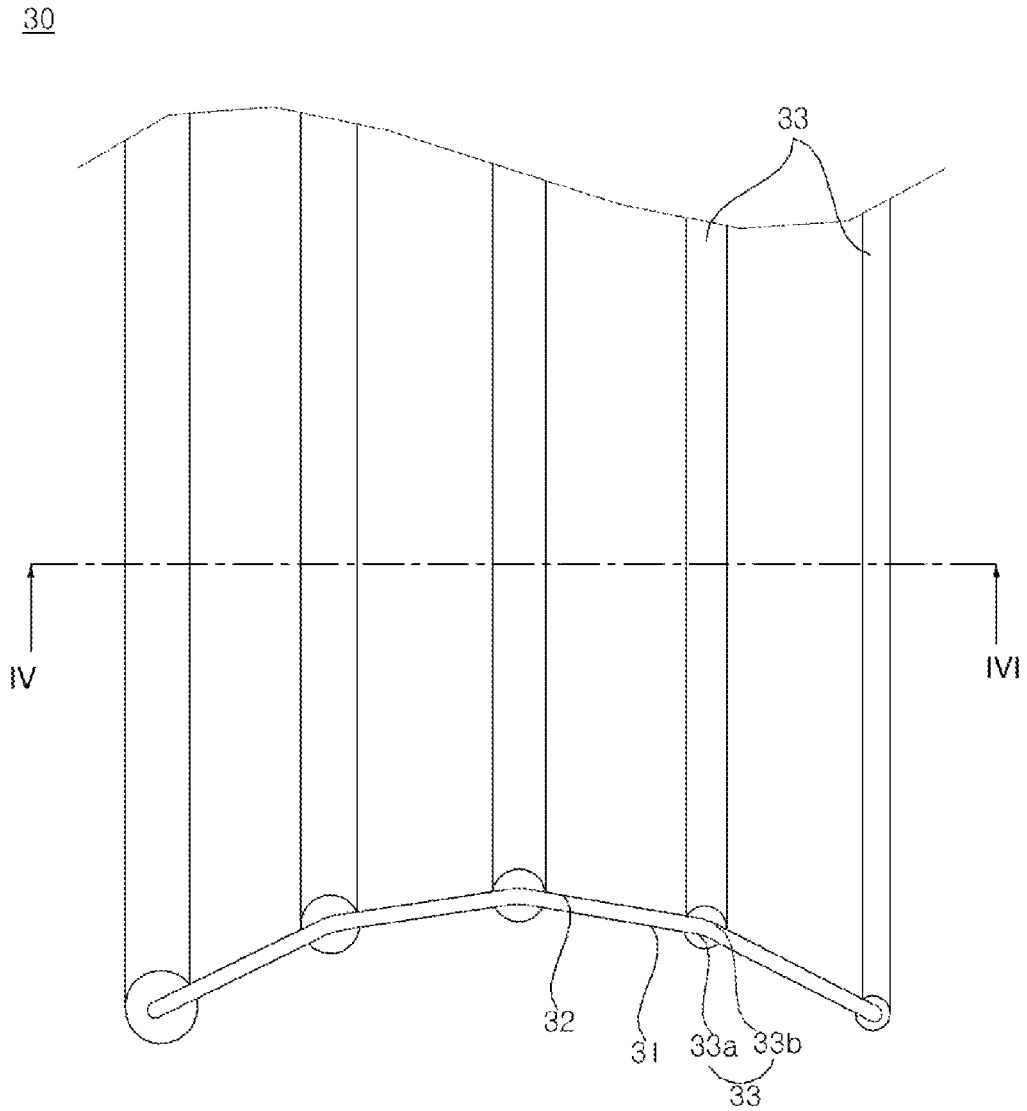
FIG. 3 shows a portion of a perspective view of a blade according to an embodiment of the present disclosure.
Figure 4:
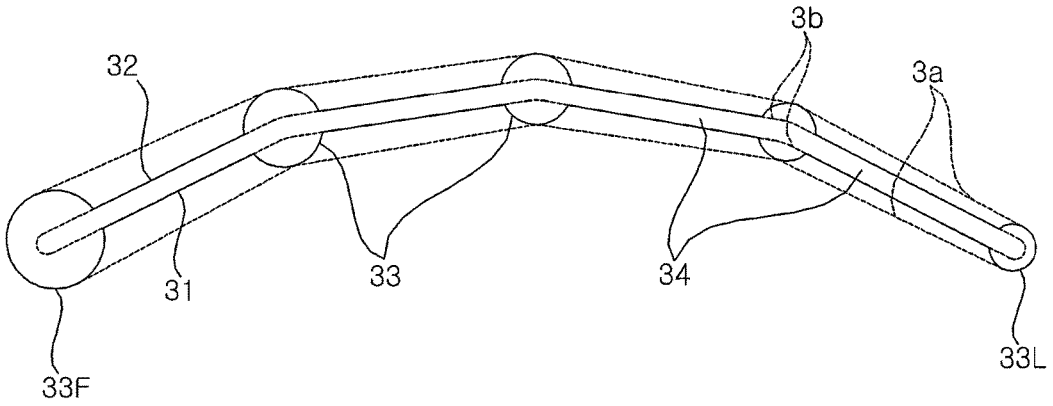
FIG. 4 is a cross-sectional view of a blade according to an embodiment of the present disclosure.

FIG. 4 is a cross-sectional view taken along line IV-IV' shown in FIG. 3. The plurality of opposing protrusions 33 may be spaced apart in the direction of the camber line C, and a front opposing protrusion 33F located innermost may be formed in the inner edge E1, and a rear opposing protrusion 33L located outermost may be formed in the outer edge E2. Centers of the front opposing protrusion 33F and the rear opposing protrusion 33L may be located on the camber line C. In addition, the centers of the plurality of opposing protrusions 33 may be all located on the camber line C.

The plurality of opposing protrusions 33 may be formed at constant intervals. Positioning at the constant intervals means a case in which the code line L is divided into equal parts when a perpendicular line is drawn from a center of each opposing protrusion 33 to the code line L.

Figure 2:
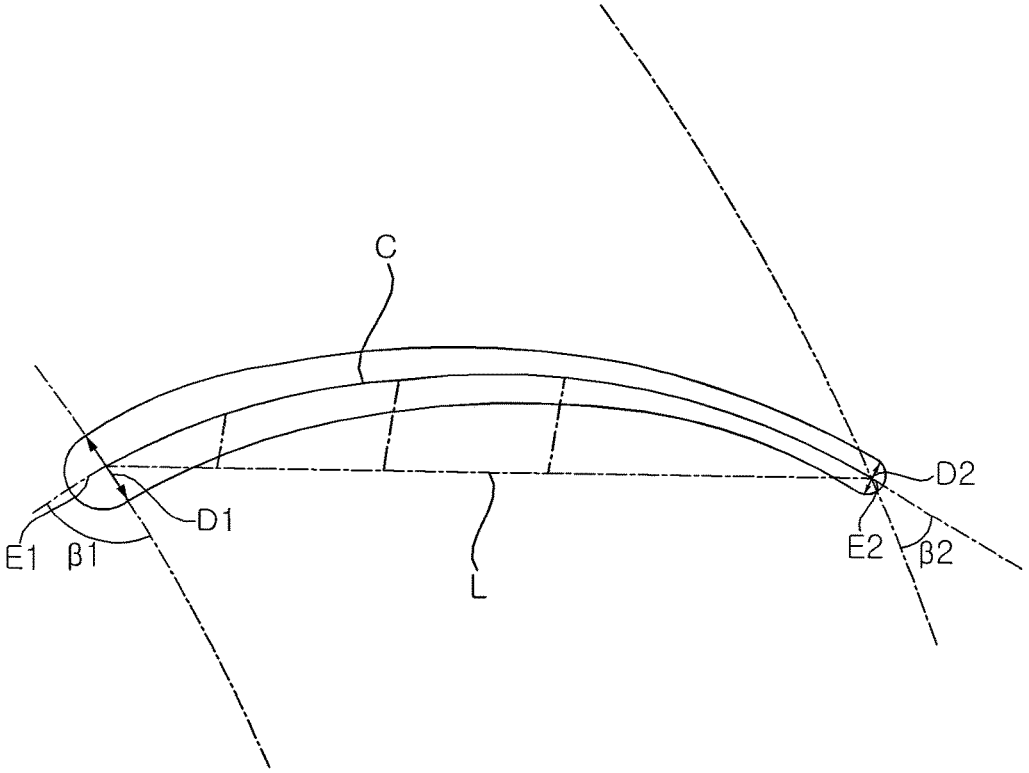
FIG. 2 is a view for explaining a design specification of a blade.

A curve 3*a* in contact with all of the plurality of opposing protrusions 33 may be the same as the surface of the conventional blade shown in FIG. 2, and accordingly, the blade 30 may be manufactured in a way of cutting the surface of the conventional blade so that the opposing protrusions 33 can be formed in the conventional blade.

The positive pressure surface 31 and the negative pressure surface 32 of the blade 30 may be each an assembly that includes a surface of an opposing protrusion 33 and a surface of a beam 34. The beam 34 may function as a structure connecting the opposing protrusions 33 spaced apart from each other, and may have a flat plate shape.

The beam 34 may have the same curvature distribution as that of the surface of the conventional blade shown in FIG. 2. Accordingly, the blade 30 may be manufactured by projecting the opposing protrusions 33 to contact a second virtual curve 3*b*, a portion of which forms a surface of the beam 34.

The plurality of opposing protrusions 33 may be formed so as to have a cross section of a cylindrical shape, and a diameter of each opposing protrusion 33 may increase in a direction toward the inner edge E1. A diameter of each opposing protrusion 33 may be inversely proportional to a distance of a center of a corresponding opposing protrusion 33 from the inner edge E1 along the camber line C.

A thickness of the beam 34 connecting each opposing protrusion 33 may increase in a direction toward the inner edge E1, and may be inversely proportional to a distance of a center of a corresponding opposing protrusion 33 from the inner edge E1 along the camber line C. The beam 34 may not be a beam 34 used to connect an opposing protrusion 33, but may have a continuous curved plate that forms the basic framework of the blade 30, and in this case, the opposing protrusion 33 may be in the shape that protrudes from the surface of the beam 34. That is, in this case, a second imaginary curve 3*b* may be a surface of the beam 34, and a thickness of the beam 34 may decrease in a direction from the inner edge E1 to the outer edge E2, and a ratio between a diameter of each opposing protrusion 33 and a thickness of the beam 34 at a position where a corresponding opposing protrusion 33 is formed may be constant.

A vortex may be formed in an area where the surface of the opposing protrusion 33 is converted to the surface of the beam 34, and accordingly, air flowing along the surface of the blade 30 may cause friction not with the surface of the blade 30, but with the vortex of relatively less frictional strength, thereby reducing an amount of separated flows. As each opposing protrusion 33 formed in each of the plurality of blades 30 are disposed to face an opposing protrusion in an adjacent blade, the above-described generation of vortex may be further enhanced by interaction of the opposing protrusions.

Figure 5:
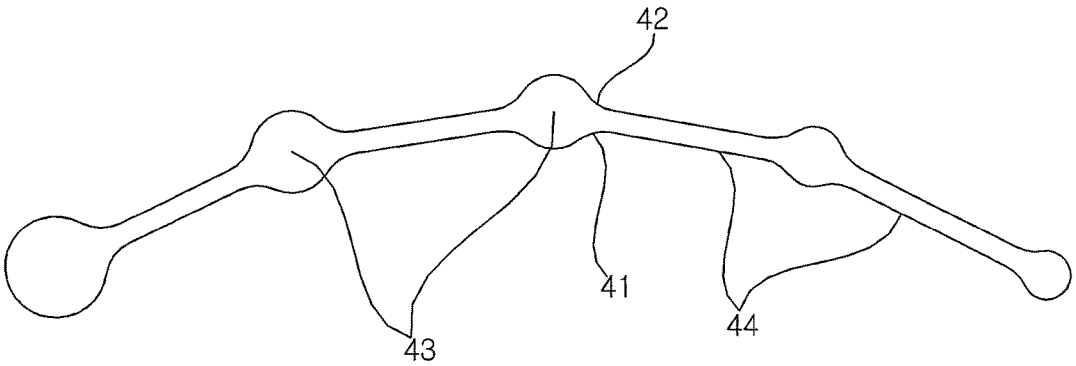
FIG. 5 is a cross-sectional view of a blade according to another embodiment of the present disclosure.

FIG. 5 is a cross-sectional view taken along line IV-IV' shown in FIG. 3 according to another embodiment. In this case, the IV-IV' cross-sectional view according to this embodiment indicates a cross-sectional view of a blade 40 according to this embodiment.

An opposing protrusion 43 of the blade 40 according to this embodiment may be formed so as to have a cross section of an elliptical-cylindrical shape. A positive pressure surface 41 and a negative pressure surface 42 formed by the blade 40 may have a continuous curvature distribution over an entire surface of the blade 40, which is a slight difference from the blade 30 according to the previous embodiment in that a discontinuous curvature distribution is formed at a portion where an opposing protrusion 33 and beam 34 of the blade 30 contact each other. In this case, a region in which the surface of the opposing protrusion 43 is converted into the surface of the beam 44 may have a smooth curved shape.

Matters such as intervals and diameters of the opposing protrusions 43 of the blade 40 according to this embodiment are the same as or similar to those described in the previous embodiment, and thus, description thereof has been be omitted.

Hereinafter, effect of noise reduction improvement of a cross-flow fan according to an embodiment of the present disclosure will be described with reference to FIGS. 6 to 8.

Figure 6:
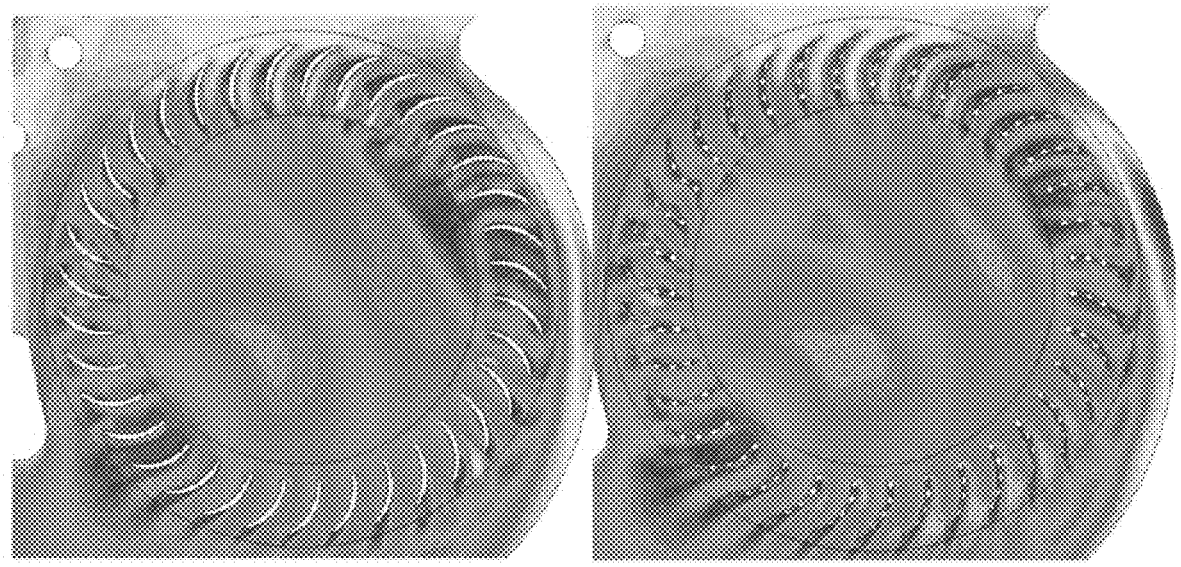
FIG. 6 is an image contouring for comparison of flow velocity distribution in a cross-flow fan according to embodiments of the present disclosure and a related art.

FIG. 6 is image contouring for comparison of flow velocity distribution in a cross-flow fan according to a related art and the cross-flow fan according to embodiments. In the overall flow velocity distribution of the image contouring, a blue area where a flow velocity is slowly distributed is wider on the left side, visually showing that an average flow velocity increases according to embodiments, and thus, it may be said that flow rate performance of the cross-flow fan is improved.

Figure 7:
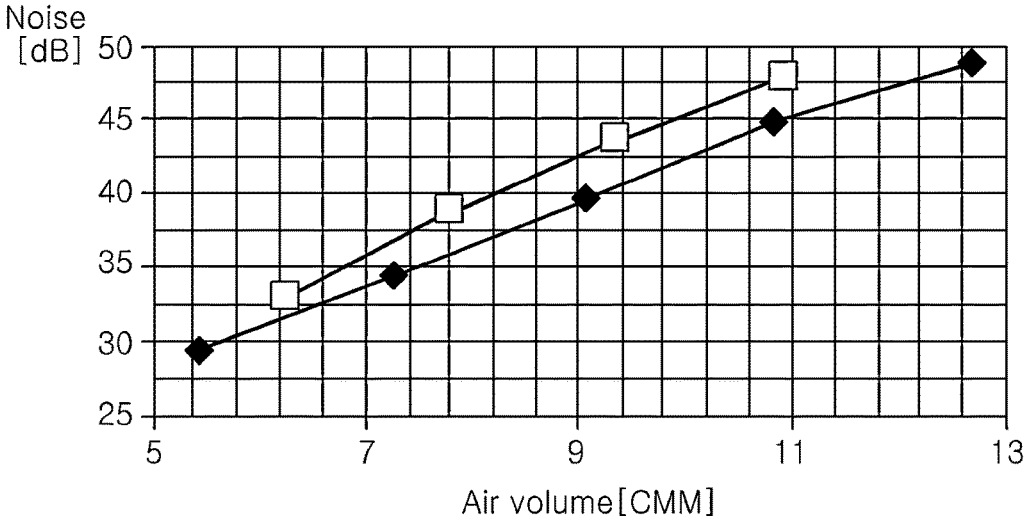
FIG. 7 is a graph showing a noise reduction effect of a cross-flow fan according to an embodiment of the present disclosure.

FIG. 7 is a graph for comparison in noise performance between a cross-flow fan according to a related art and a cross-flow fan according to embodiments. The X-axis of the graph represents an air volume flowing into a cross-flow fan, and the Y-axis represents a noise value measured at a corresponding air volume.

A line connecting rectangular dots indicates noise measurement values according to the related art, and a line connecting rhombus dots indicates noise measurement values according to embodiments. A smaller noise value is measured in the cross-flow fan according to embodiments in the overall air volume range, and it may be found that noise reduction performance is improved accordingly.

Figure 8:
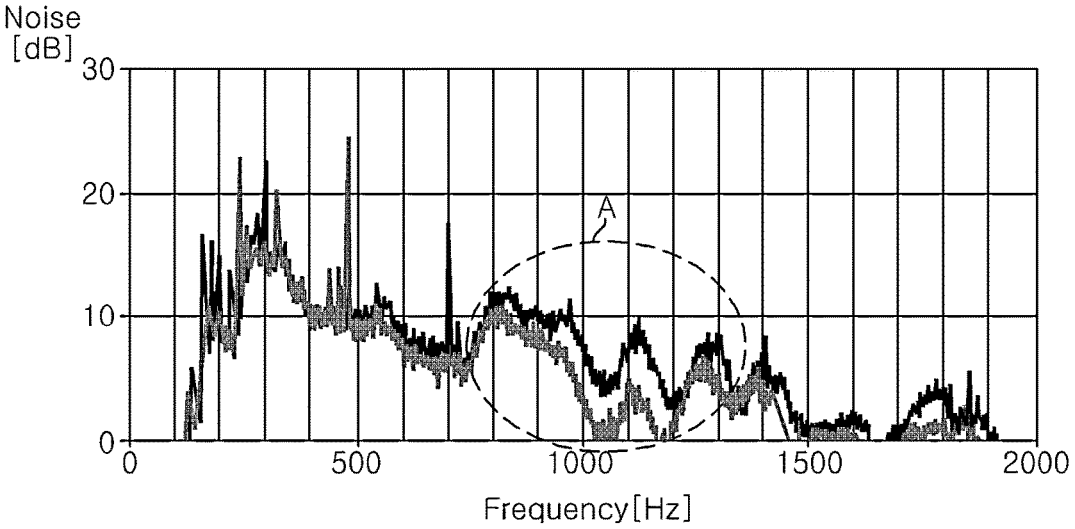
FIG. 8 is another graph showing a noise reduction effect of a cross-flow fan according to an embodiment of the present disclosure.

FIG. 8 is a graph for comparison in noise reduction performance between a cross-flow fan according to a related art and a cross-flow fan according to embodiments through noise spectrum analysis. The X-axis of the graph represents a frequency range of generated noise, and the Y-axis represents intensity of the generated noise in decibel (dB).

A black line on the graph indicates a noise spectrum of the cross-flow fan according to the related art, and a gray line indicates a noise spectrum of the cross-flow fan according to embodiments.

The noise intensity of the cross-flow fan according to embodiments in area A (800 to 1300 Hz) in the drawing is measured as about 5 dB lower than that of the related art, and it may be found that noise reduction performance is improved accordingly.

While embodiments have been illustrated and described above, the embodiments are not limited to the aforementioned specific embodiments, various modifications may be made by a person with ordinary skill in the technical field to which the embodiments pertain without departing from the subject matters that are claimed in the claims, and these modifications should not be appreciated individually from the technical spirit or prospect.

The invention claimed is:

1. A cross-flow fan, comprising: a rotary shaft; a plurality of blades spaced apart from each other at a predetermined angle about the rotary shaft, each blade extending in a direction parallel to the rotary shaft and having a positive pressure surface and a negative pressure surface; and a connector that connects the plurality of blades and the rotary shaft, wherein at least one protrusion that protrudes in a thickness direction of the plurality of blades and extends in a longitudinal direction of the plurality of blades is formed on each of the positive pressure surface and the negative pressure surface of each blade, wherein the protrusion formed on the positive pressure surface and the protrusion formed on the negative pressure surface protrude in opposite directions to thereby form a plurality of pairs of opposing protrusions, wherein the plurality of the pairs of opposing protrusions is formed spaced apart from each other in a direction of a camber line of each blade, wherein diameters of the plurality of pairs of opposing protrusions decrease in a direction from an inner edge to an outer edge of each blade, and wherein a distance between each of the plurality of pairs of opposing protrusions arranged adjacent to each other is formed to be longer than the diameter of each of the plurality of pairs of opposing protrusions.

2. The cross-flow fan of claim 1, wherein the plurality of pairs of opposing protrusions extend from a first end to a second end in the longitudinal direction of the each blade.

3. The cross-flow fan of claim 1, wherein the plurality of pairs of opposing protrusions each have a cross section of a circular shape.

4. The cross-flow fan of claim 3, wherein a first pair of the plurality of pairs of opposing protrusions is formed on the inner edge of each blade, and wherein a second pair of the plurality of pairs of opposing protrusions is formed in the outer edge of each blade.

5. The cross-flow fan of claim 1, wherein centers of the plurality of pairs of opposing protrusions are located on a camber line of each blade.

6. The cross-flow fan of claim 1, wherein intervals between the plurality of pairs of opposing protrusions are formed to divide a code line into equal parts when a perpendicular line is drawn to the code line from a center of each of the opposing protrusions.

7. The cross-flow fan of claim 1, wherein the plurality of pairs of opposing protrusions is connected to a beam, both sides of the beam form a portion of the positive pressure surface and a portion of the negative pressure surface.

8. The cross-flow fan of claim 7, wherein a surface of the beam is flat.

9. The cross-flow fan of claim 7, wherein a thickness of the beam decreases from the inner edge to the outer edge of each blade.

10. The cross-flow fan of claim 1, wherein the positive pressure surface and the negative pressure surface have a continuous curvature distribution before and after one pair of the plurality of pairs of opposing protrusions.

* * * * *